United States Patent [19]

Braun et al.

[11] Patent Number: 4,516,714

[45] Date of Patent: May 14, 1985

[54] HIGH SPEED DUPLICATOR WITH SORTER/STAPLING APPARATUS AND STAPLER POSITIONING CONTROL

[75] Inventors: Oskar J. Braun, Williamson; Lawrence C. Hubler, Fairport, both of N.Y.

[73] Assignee: Xerox Corporation, Stamford, Conn.

[21] Appl. No.: 563,736

[22] Filed: Dec. 21, 1983

[51] Int. Cl.[3] ..... B27F 7/17

[52] U.S. Cl. ..... 227/78; 227/111; 227/156

[58] Field of Search ..... 227/78, 110, 111, 156; 355/3 R

[56] References Cited

U.S. PATENT DOCUMENTS 3,534,896 10/1970 Speller et al. ..... 227/111 X 4,313,670 2/1982 Caldwell ..... 227/111 Y

*Primary Examiner*—Paul A. Bell

*Attorney, Agent, or Firm*—Bernard A. Chiama

[57] ABSTRACT

A fastening apparatus having two or more stapling devices and drives for moving either of the devices selectively to permit selective positioning of staples before a stapling operation. An indication system cooperates with the drives for operator use in selecting the positioning of staples for different sizes of sheets to be fastened.

3 Claims, 6 Drawing Figures

44
85
64
87
68
67
65
M-1
SOL-2
50
62
60

HIGH SPEED DUPLICATOR WITH SORTER/STAPLING APPARATUS AND STAPLER POSITIONING CONTROL

This invention relates to a reproduction system, or copying machine, having an improved finishing station for use in such system.

With the advent of higher speed and more sophisticated copy producing machines, printing presses, and the like, considerations as to how the mass of copies generated can best and most effectively be handled has assumed increasing importance. One way has been to provide a copying system with an input device in the form of a recirculating document handling apparatus. In this system, a document sheet is removed from a collated set of document sheets, placed on an exposure platen for exposure at the rate of one exposure for each document sheet, and returned to the top of the set in the document handling apparatus until the set of document sheets has been completely circulated through the apparatus, and a copy set has been produced. The set of document sheets is then recycled for the reproduction of a second copy set, and so on. After each copy set is produced and collected at a collection station, a finishing device such as a stitcher or stapler is activated to bind the set. These systems are of the pre-collation type wherein the document sheets are pre-collated in the document handling apparatus prior to commencement of a reproduction run. The output for the reproduction machine will likewise be pre-collated in sets corresponding to the sequenced numbered document set in the document handling apparatus. The copy sheets are collected in collated sets as they are sequentially produced so that binding may be effected without the interaction of additional devices. Such systems are described in U.S. Pat. No. 4,134,672.

Another type of copying arrangement known as a post-collation system utilizes document handling wherein a predetermined number of light images are produced for each document sheet, say for example, of page one of a multi-page document, before a successive document sheet, perhaps page two of the document is likewise imaged. This sequencing in turn may be repeated many more times if a very large number of copy sets are to be reproduced. As the copy sheets are being produced in accordance with the above imaging procedure, an array of collecting bins or sorter is positioned and vertically moved in either direction to receive the copy sheet output for collating the copy sheets into collated sets, if the system has been programmed for the sets mode of operation or into stacks if in the stacks mode of operation. The bin array or sorter in effect serves as a buffer in the production of finished copy sets when in the sets mode of operation. As these sets are being produced, a pair of finishing devices such as stitchers or staplers are positioned and activated to apply a staple to each set as they are completed. A copying arrangement of this type is disclosed in U.S. Pat. No. 4,444,491 for which the present invention is particularly adapted for incorporation, and therefore the disclosure in this patent is herein incorporated by reference.

Regardless of whether the copying system is of the pre-collation type or of the post-collation type, the use of two or more stapling devices has introduced problems regarding the accurate desirable positioning of the devices along the bound edge of a copy set before stapling thereof. The problem is compounded for copying systems which are capable of providing copy sheets of varied copy lengths along which staples are applied, such lengths encompassing a range of between ten inches to fourteen inches. In addition, it may be desirable to provide a staple at a position on the copy set which is particularly adapted for landscape arrangement of copy sheets, that is, with copy sheets in a set arranged with the long dimension extending from top to bottom to right when correctly observing the data on the copy sheets.

It is therefore the object of the present invention to utilize a stapler positioning system for a copier or duplicator which provides maximum accuracy and a variety of desirable locations for the particular run programmed for the copier or duplicator.

The present invention is incorporated with a stapling apparatus for binding copy sheets received in succession at a sheet collecting device, or sorter, having a series of individual bins each with an inlet for receiving individual sheets at a sheet receiving station, set transport means for removing each set of collected sheets from the bins; a pair of stapler devices for binding each set after removal from the sorter; and controls for the above.

Other objects and advantages will be apparent from the ensuing description and drawings in which.

Figure 1:
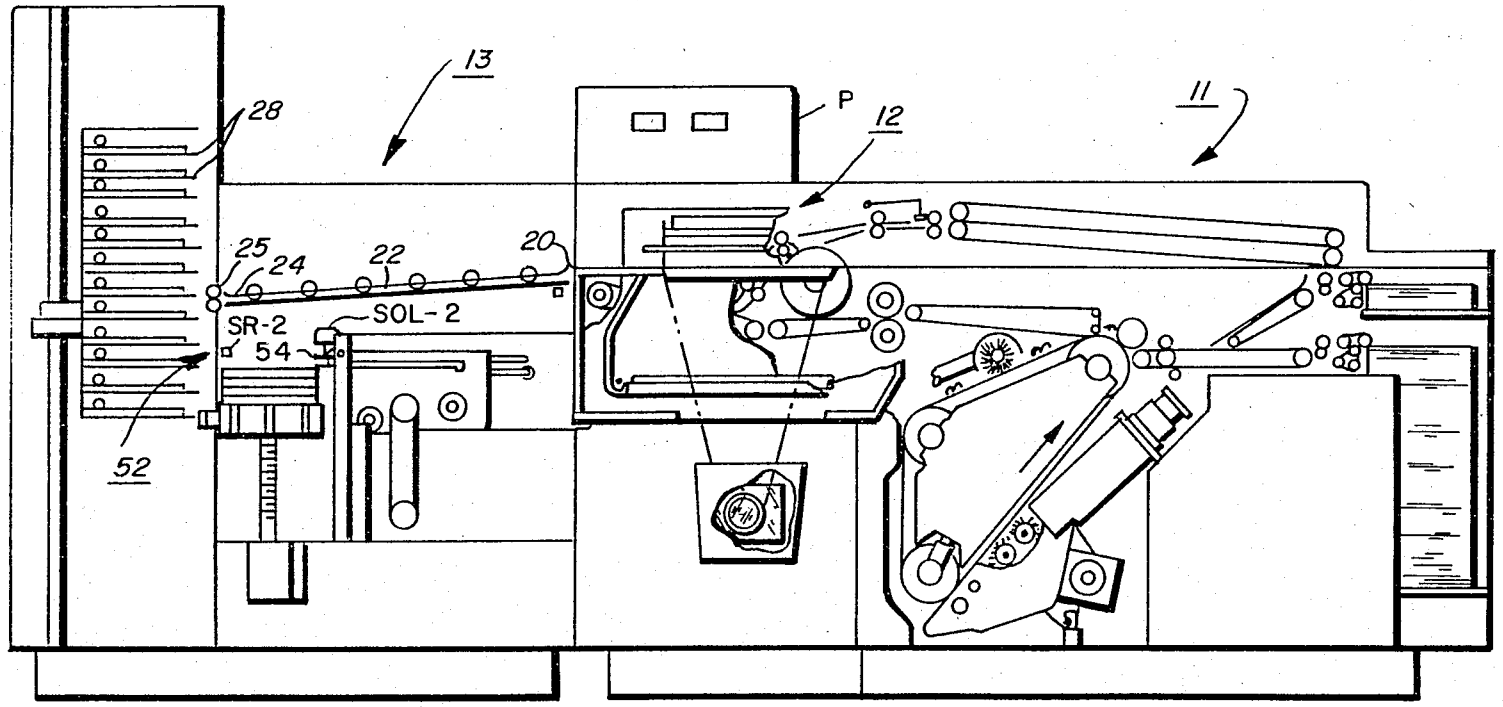
FIG. 1 is a schematic illustration of a configuration of an electrostatographic printing/stapling system employing the present invention.

For a general understanding of a reproduction machine with which the present invention may be incorporated, reference is made to FIG. 1 wherein components of a typical electrostatic printing system or copier are illustrated. The printing system is preferably of the xerographic type as one including a xerographic processor 11, and a document handling apparatus 12. Preferably, the processor 11 is the same as the processor in the commercial embodiment of the Xerox duplicators, models 9400 and 9500 which utilize flash, full frame exposure, for very high speed production. Similarly, the document handling apparatus 12 is the same as those used in the same machines. It will be understood that most any other type of xerographic processor and multiple exposure document handling apparatus may be utilized. Copy sheets are processed in the processor 11 in the conventional xerographic manner as reproductions of document sheets placed in the apparatus 12 and circulated to an exposure station for the copier. A resultant stream of copy sheets exit the processor, and for the particular duplicators identified herein, the stream comprises groups of identical copy sheets awaiting to be collated. Operating in conjunction with the processor 11 and apparatus 12 is a finishing station 13 and thereby forms the reproduction system shown in FIG. 1.

The system comprising the processor 11 and the document handling apparatus 12 is under control of a Programmer P which permits an operator various options: to turn the entire system ON or OFF; to program the reproduction system for a desired number of reproductions to be made of each original document sheet or set; to select whether simplex or duplex copies are to be made; to select a desired output arrangement, that is, sets mode or stacks mode, stapled or unstapled; to select one of a plurality of paper trays; to condition the machine for the type of document, that is, whether one sided or two sided, to select a copy size reduction mode, and other desirable functions. The Programmer P also includes a controller which provides all operational timing and synchronization between the processor 11 and all of its xerographic processing functions, and system control functions, the automatic events to be described hereinafter. The controller may include any suitable microprocessor having a CPU and the appropriate machine clock, but preferably the processor is one similar to the Intel 8080 microprocessor manufactured by the Intel Corporation, Santa Clara, Calif., and having sufficient ROM's and RAM's for all the necessary functions in the reproduction system.

Further details of the processing devices and stations in the printer system or processor are not necessary to understand the principles of the present invention. However, a detailed description of these processing stations and components along with the other structures of the machine printer are disclosed in U.S. Pat. No. 4,054,380 which is commonly assigned with the present invention and which is incorporated by reference herein. For the complete apparatus and description thereof to which the present invention may be applied is illustrated and described in U.S. Pat. No. 4,444,491 commonly assigned, and which is incorporated by reference herein.

Copy sheets exiting the processor 11 are transported through an exit slot 20. The sheets are directed to the finishing station 13 which comprises a sorting mechanism, a stapler apparatus, and an output elevator/conveyor system. After leaving the processor 11, as shown in FIG. 1, each sheet is positioned upon a transport 22 to be further conveyed generally along the same horizontal plane as its previous path to a fixed receiving point or station 24.

At the exit slot 20, a sheet contacting switch S-1 is positioned to be actuated as each sheet enters the transport 22 of the finishing station 13. The circuit for this switch is connected to the logic in the Programmer P and serves to reset the machine clock for the finishing function so that zero time for the sheet commences when the sheet is at the reference point 24.

At the receiving station 24, there is positioned a pair of contacting transport rollers 25 which receive each copy sheet within the nip for directing a sheet into a bin of an array of collecting bins, or sorter generally indicated by the reference numeral 28. In the illustrated embodiment, the array 28 includes twelve horizontally disposed bins 30 arranged in a vertical column, the number of which corresponds to the predetermined number of exposures made of each document sheet while it is on the platen for the copy processor 11.

The array 28 is mounted for bi-directional vertical indexing movement within a supporting fixed machine frame 32 and is positioned in its normal standby position with the lowermost bin opposite the nip of the rollers 25 at the fixed station 24. Details as to structural and operating sequences is described in the above referenced to U.S. Pat. No. 4,444,491.

As described hereinafter in the above referred to patent, a set stapling system in the form of a dual stapler apparatus is arranged immediately below the bin receiving point 24. This apparatus includes means to remove completed sets of collated copy sheets from every other bin to effect single or dual stapling along an edge of the set if so programmed or not stapling at all, and to position the stapled or unstapled sets on an elevator mechanism. In order to permit complete removal of the sets from all of the bins 30 in the array 28, the array must move twice relative to the point of set unloading.

The bin array 28 is driven vertically in either direction in indexing fashion by a screw 34 connected to the shaft of a servo motor mounted on the base of the frame 32. Rotation of the screw 34 (which is fixed against axial movement) in either direction will impart corresponding up or down movement of the ball the array 28.

Figure 3:
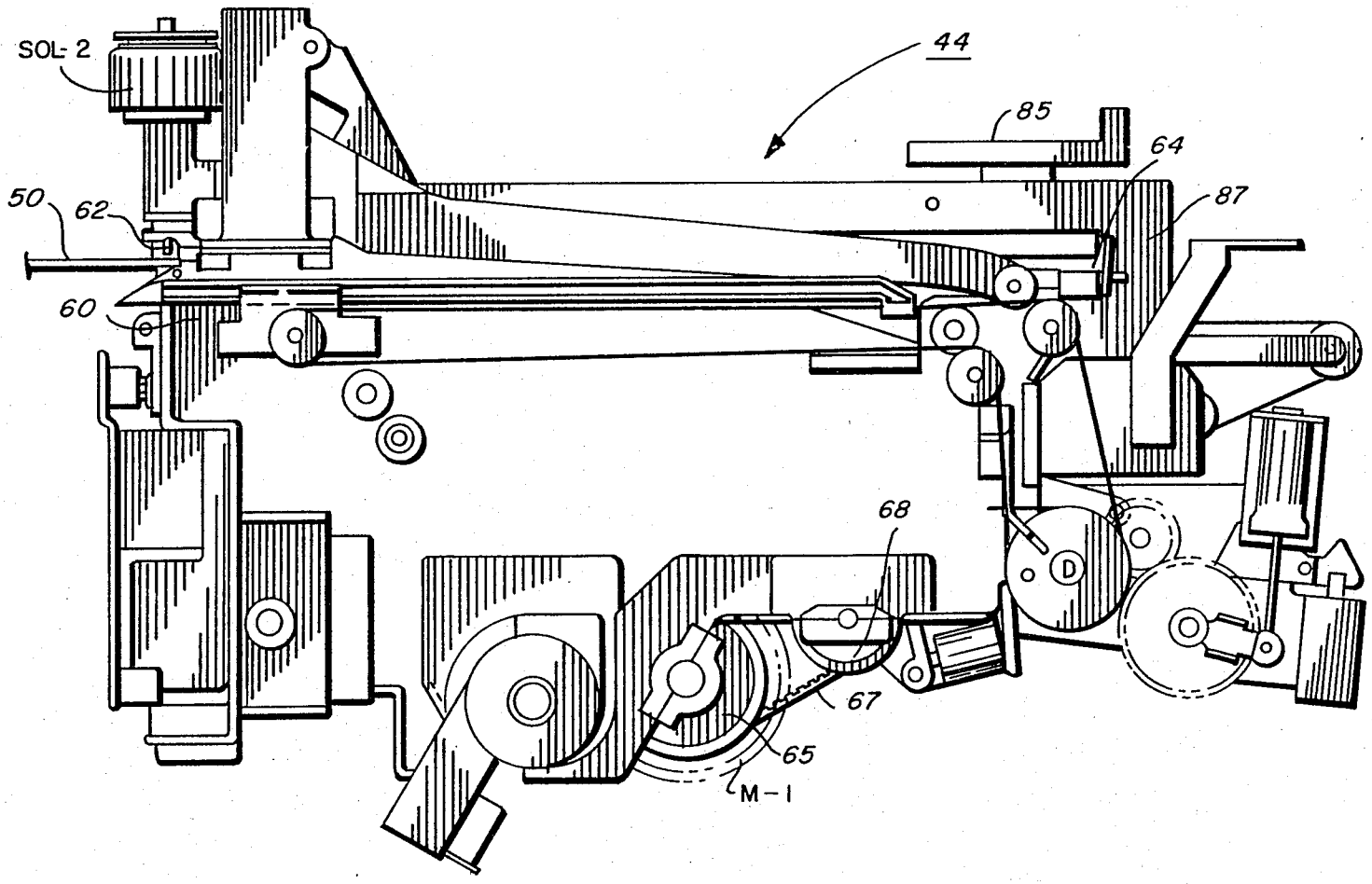
FIG. 3 is an isometric view of one of the stapling devices utilized in the present invention.

After copy sheets, simplex or duplex, have been produced in the processor 11, transported by the transport 22 and collected in the bin array 28 while the system is in either the sets mode or the stacks mode, the collected sets are now in condition to be further processed by a finishing apparatus generally indicated by the reference number 40. The finishing apparatus comprises five subassemblies each of which is programmed to operate in timed sequence with each other, with the system logic and programmer P, to be timed relative to the number of sets and copy sheets per set which were previously pre-programmed, and with the document sheet actuation of the apparatus 12. As shown in FIGS. 1 and 3, the finishing apparatus comprises a set transport 42, individually operable, dual stapler devices 44, and a set kicker (not shown). In conjucntion with the finishing apparatus 40, the finishing station 13 also includes an elevator 46.

Figure 2:
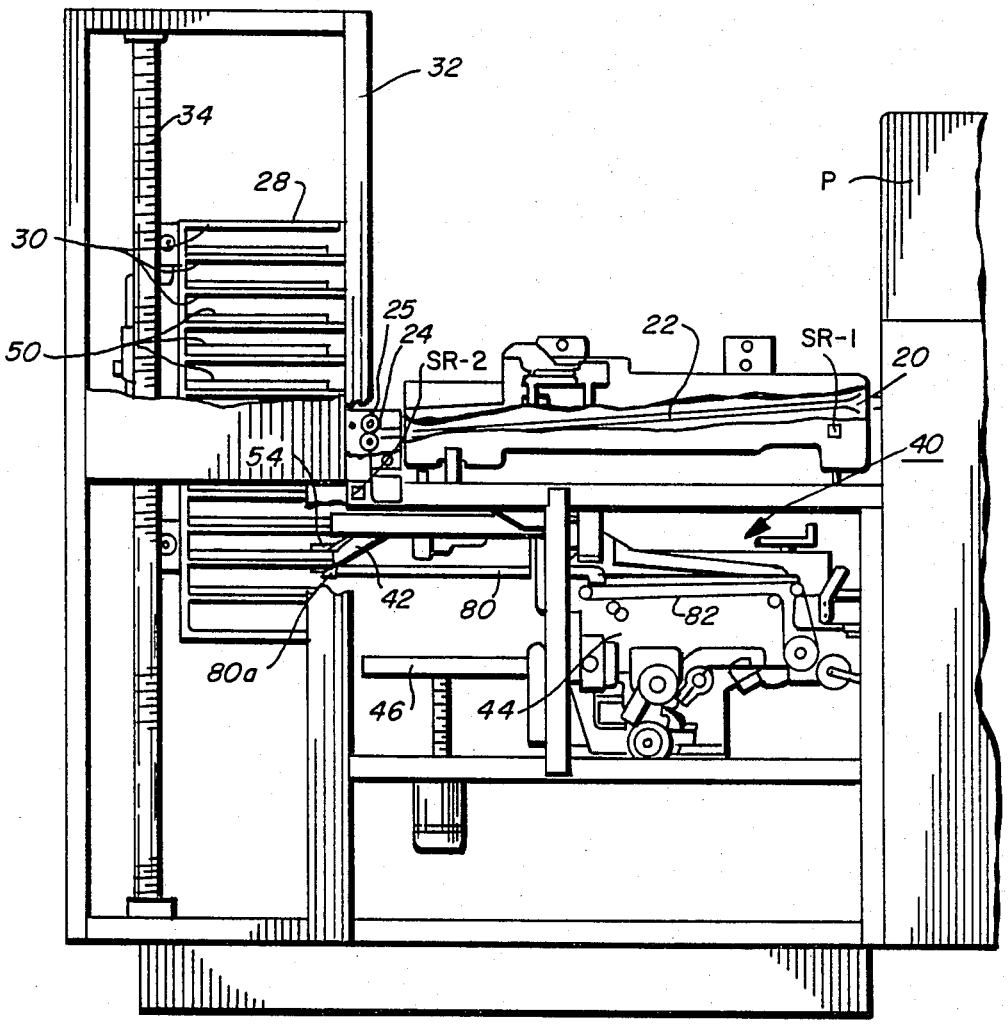
FIG. 2 is an elevational view of the stapling station utilized in the system of FIG. 1.

The set transport 42 is utilized to unload automatically sets 50 or stacks of copy sheets from the bins at an unload station 52 two copy cycle pitches or bins below the sorter bin load station at 24. As shown in FIG. 2, the set transport 42 includes a clamp 54 which is adapted to grip an edge of a set or stack and convey the same from the bin array to the stapler apparatus 40 for a stapling operation, if that has been pre-programmed, or directly to the elevator 46 if programmed for the non-stapled mode.

The set 42 transport also includes a reversible servo motor (not shown) to effect reciprocable movement of the clamp 54 to the sorter to a set gripping position, in the opposite direction to a set stapling position, and still further in that direction, to retract the clamp all in cyclic actuation. In moving toward the sorter 28, the clamp 54 is sensed by sensor SR-2 mounted on the frame for the sorter to zero reference the positioning of the set transport as a timing monitor of subsequent timed events in the finishing function. The clamping and unclamping action of the clamp 54 is provided by a solenoid valve (not shown) in a suitable pneumatic power device which may be operatively connected to the clamp.

The stapler apparatus 40 as shown in FIG. 2 provides a stapling function with two staples, both being adapted to be applied at various positions along a long edge of a set or stack of copy sheets. Stapling is achieved by way of the two identical mechanisms each of which provides the function of set clamping, staple driving, and staple clinching. Preferably, the apparatus utilizes two commercial type stapler heads such as the Bostitch staple head indicated as the 64-E manufactured by the Bostitch Division of Textron Corporation of Providence, R.I..

As shown in FIG. 3, each of the stapler devices 44 comprises the stapler head 60 having a clamping position 62 to which an edge of each copy set is transported by the set transport 42. At the position 62, the stapler head 60 is adapted, upon energization of a solenoid SOL-2 to effect clinching of the legs of a staple after the same has been separated from a stick of staples within a staple magazine 64 in the head 60, driven by a driver (not shown) in the head 60 through the sheets of the copy set in the conventional manner. With one or more staples being driven through the sheets of the copy sets, clinching of the staple legs is then accomplished by the energization of the solenoid SOL-2, as aforesaid.

Stapling by each of the stapling devices 44 is accomplished by a drive system including a drive pulley 65 connected to the shaft of a drive motor M-1 for driving both devices 44. Further details of this drive system and staple drive is fully disclosed in the above referred to U.S. Pat. No. 4,444,491 which is hereby incorporated by reference and therefore are not necessary for understanding the present invention. In operation of the stapling devices 44, the motor M-1 is in continuous operation and electromagnetic wrap spring clutches within the stapling drive system are energized at approximate timed relationship to drivingly convert the motor M-1 to the various gears and pulley to effect clamping of a copy set 50 within the clamping station 62, driving of one or more staples through the edge of the copy set being bound, and clinching of the staple legs by energization of the solenoid SOL-2, as aforesaid.

Figure 4:
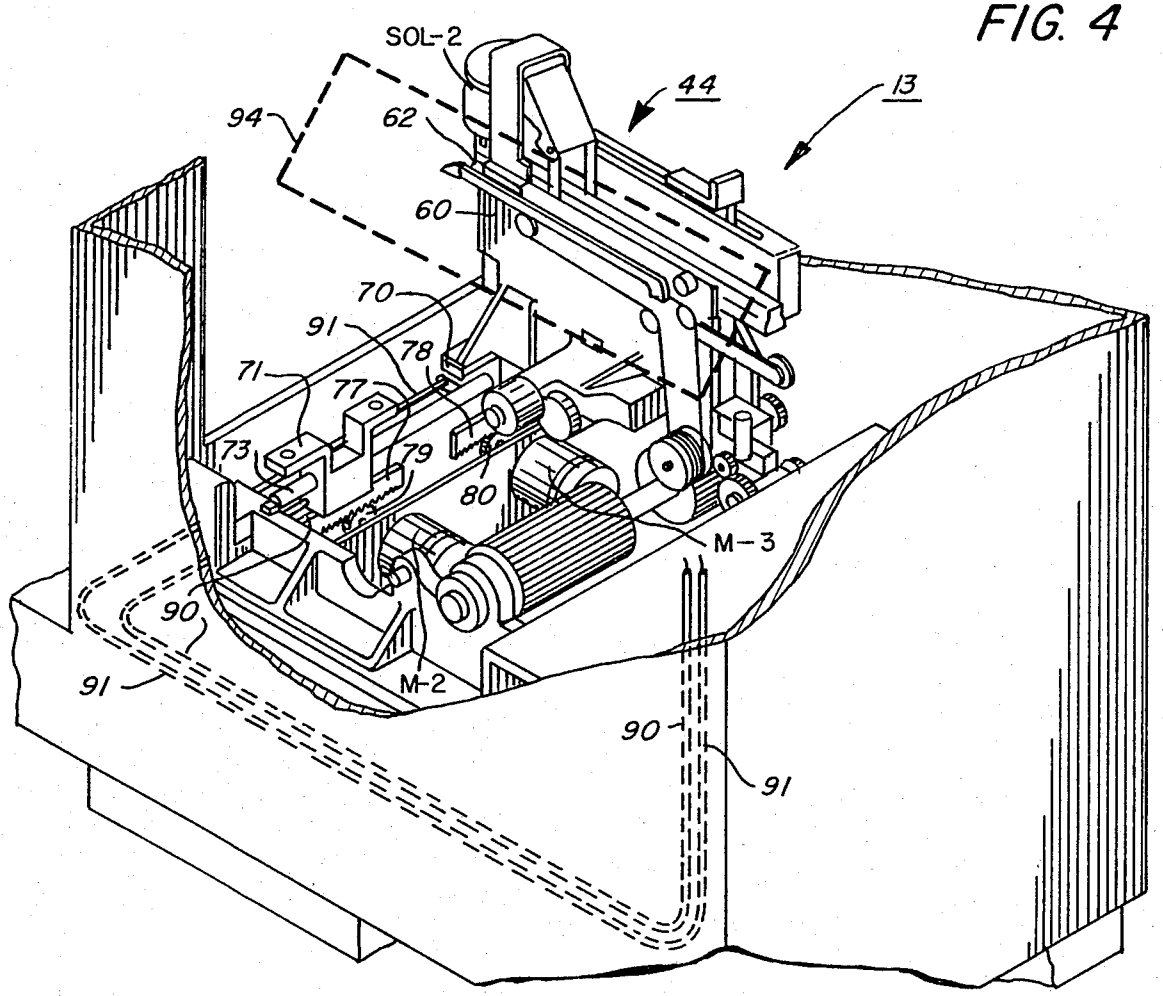
FIG. 4 is an isometric of the stapling apparatus showing the positioning devices therefor.
Figure 5:
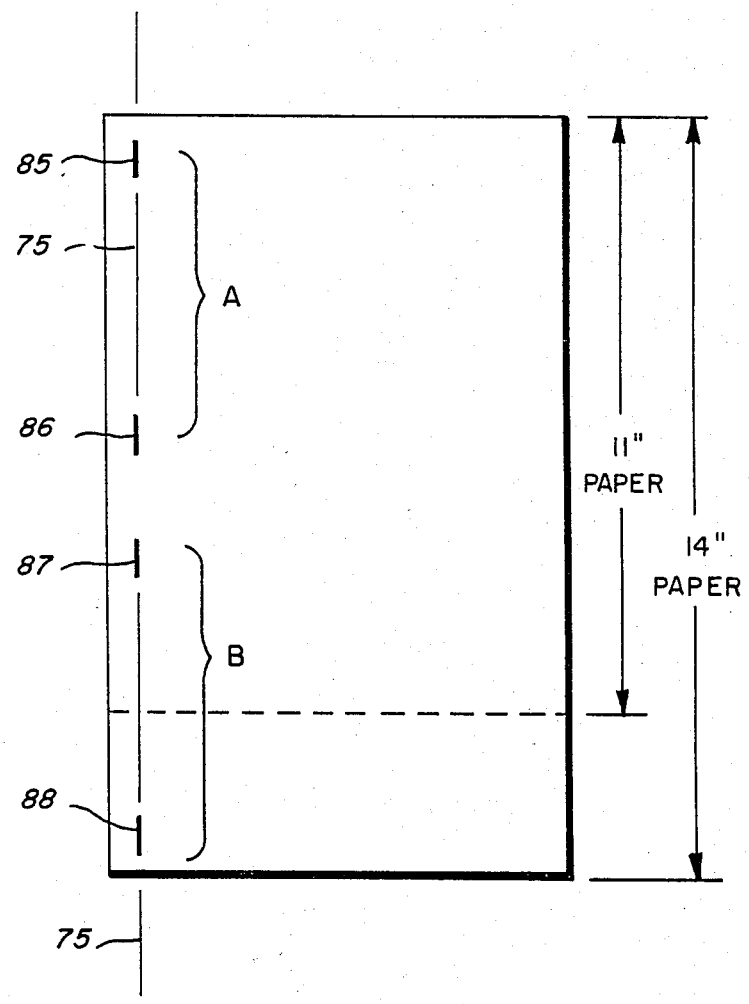
FIG. 5 is a diagram of the range of positions on various sizes of sheets for which staples may be applied in accordance with the present invention.

As shown in FIG. 4, each of the two stapler devices 44 (only one is shown) is mounted on a bracket 70, 71 respectively, which are slidably supported and mounted on a guide rod 73 secured at its ends to the frame of the finishing station 13. The guide rod 73 is arranged parrallel to a line 75 extending within and between the clamping position 62 of the stapler heads 60 so that the positioning of the stapler heads along the rod 73 will not affect the positioning distance of a stapler relative to the edge of a copy set being stapled. As shown in FIG. 5, the line 75 represents the line of staple positions along which the devices 44 are adapted to apply a staple, in accordance with the present invention, as will be described below.

Associated with each of the support brackets 70, 71 is a depending gear rack 77, 78, respectively, which are longitudinally arranged in alignment and is parallel with the support rod 73. Each of the gear racks 77, 78 is operatively engaged with a gear 79, 80, respectively, each being secured to the drive shaft for a stapler reversible positioning motor M-2, M-3. The motors M-2, M-3 are connected to the logic circuit for the Programmer P to be energized to drive the support brackets 70, 71, respectively in the appropriate direction and distance in accordance with the control system to be described below.

A first stapler device 44 is mounted on the support bracket 71 and for further description will be labelled stapler "A". A second stapler device (not shown) is mounted on the support bracket 70 and is labelled stapler "B" for further description. Each of the devices A and B are adapted to be moved along a line continuous to a line joining the clamping positions 62 for the stapler devices. Such movement of each of the stapler devices is bidirectional within a limited range with such movement being adapted to permit stapling along the line 75, as shown in FIG. 5 within their respective ranges.

In FIG. 5, the range of stapler movement for the device A is defined by the distance within the bracket A, between the staple positions 85 and 86. The range of stapler movement for the device B is defined by the distance within the bracket B between the staple positions 87 and 88. Pursuant to accomplishing these movements, the motors M-2 and M-3 are operatively associated and controlled by the Programmer P to be energized selectively individually or in unison, to different positions within their respective range of movement.

Figure 6:
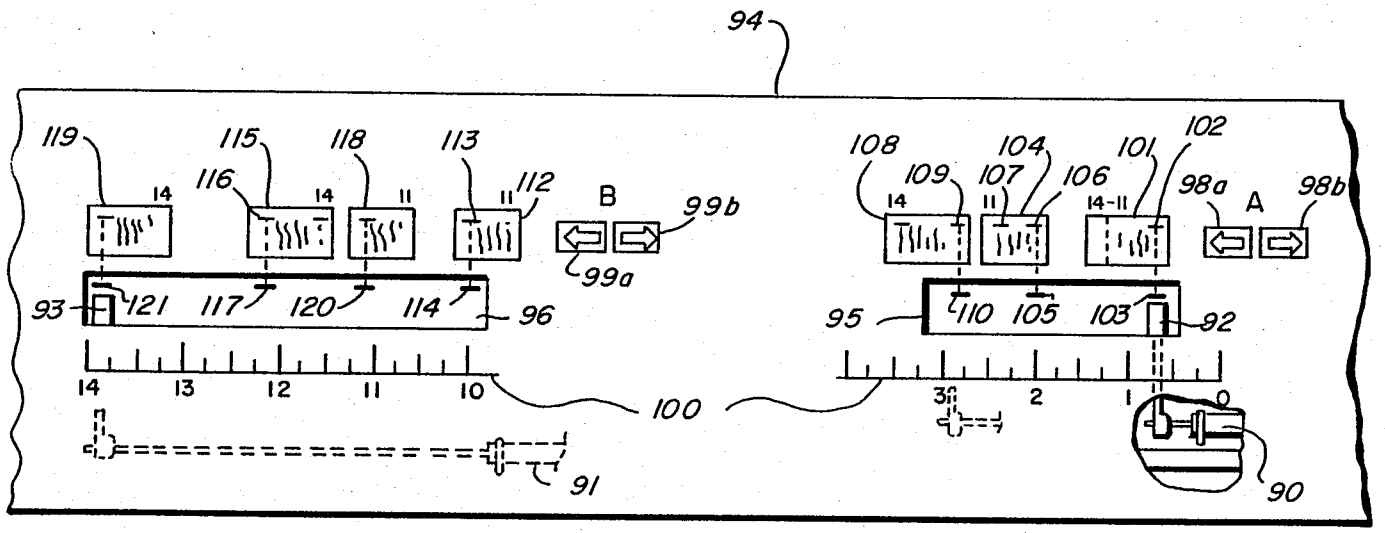
FIG. 6 is a partial view of the control console for the stapler station.

In order to control and provide indication as to the precise positioning of each of the stapler devices 44, each of the support brackets 70, 71 has mounted thereto one end of a flexbile cable 90, 91, respectively. The other ends of the cables 90, 91 are connected to movable mechanical indicators, 92, 93, as shown in FIG. 6, each indicator serving as a display indication for an operator at the control console 94 of the finishing station 13. As one of the stapler devices, such being represented as stapler A, is moved within its range of movement, such as within the bracket A of FIG. 5, the cable 90 will correspondingly cause movement of the indicator 92 within its range of movement in a window 95. Similarly, as the other stapler device, such being represented as stapler B, is moved within its range of movement, such as within the bracket B of FIG. 5, the cable 91 will correspondingly cause movement of the indicator 93 within its range of movement in a window 96.

It will be noted that window 96, or B window, is slightly larger in length than window 95, or A window. Such a difference will be understood since the A stapler is operable upon the top left hand corner of a copy set which corner is registered for all sheet sizes even when a single staple has been programmed. On the other hand, the B stapler wil be operable on the lower portions of copy sheets and since the system is adapted to process and finish copy sheets of varying sizes, that is, from less than 11 inches in length to 14 inches in length, the B stapler device must be adapted for movement which spans a greater distance.

Energization of the motors M-2, M-3 is under control by pushing buttons on the console 94. A first pair of push buttons **98*a* and 98*b* are connected to a circuit to the motor M-3 and the Programmer P, and as shown by the arrows on the buttons, depression of either will energize the motor M-3 in a direction to move the staple device associated with the motor M-3 in the direction of the arrow display on the particular button actuated. For example, if the button 98*a* is actuated, the M-3 will be energized in a direction to move the A stapler device on the bracket 71 to the left as viewed in FIG. 4 until the button is released. In so doing, the indicator 92 will move to the left and stop accordingly, as viewed in FIG. 6. Actuation of the button 98*b* will provide reverse movement of the A stapler device and the indicator 92**.

A second pair of push buttons **99*a* and 99*b* are similarly associated with the B stapler device. Upon depression of the button 99*a*, the bracket 70 will be moved to the left when the motor M-2 is energized and the indicator 93 will move to the left accordingly. In this manner, both stapler devices may be moved to any position within their respective range of movement with the indicators 92, 93** providing the operator with instant indication of the movement and positioning of the devices.

As shown in FIG. 6, an inch scale 100 up to slightly more than 14 inches long is drawn on the console reading from right to left. Both windows 95 and 96 are arranged along the scale 100 and have their respective lower edge to form a part thereof. The A window 95 spans across a little more than three inches of this scale and the B window 96 spans across approximately six inches of the scale. Above the A window there are three displays of pictorial representations or pictographs of a copy sheet illustrating one or more staples applied thereto. Similarly, above the B window 96, there are focus pictographs of a copy sheet illustrating one or more staple positions.

The pictograph 101 depicts a copy sheet which may be of any size being processed in the reproduction machine, anywhere from less than 11 inches long to 14 inches in length. In this discussion of sheet sizes, it is assumed that the sheets are of standard width, that is, 8½ inches, and that copy sheets are transported into the collating bins 28 in a direction parallel to their width, that is, the length dimension is perpendicular to the direction of movement. The pictograph 101 includes a line 102 depicting a staple and is associated with a indication reference point 103 within the A window 95. When an operator actuates either of the buttons 98*a*, 98*b*, to bring the indicator 92 into alignment with the line 102, the A stapler device will be moved, as aforesaid, to a position which, when actuated, will apply a staple in the top left hand corner of a copy set.

As previously stated, the pictograph 101 is representative of any size copy sheet and the numerals 14–11 scribed thereon denotes to the operator that it applies to all sizes capable of being handled by the machine. The Programmer for the machine is preferably programmed to actuate the A stapler device for all modes of operation wherein a stapling operation is to be performed. Therefore, the A stapler device will always operate when a reproduction run calls for either single staple or double stapling.

The pictograph 104 depicts that 8½ inch by 11 inch copy paper is being utilized and that the two staples are to be applied to each copy sheet. The indication reference line 105, however, is associated with a single staple line 106 and when the A stapler device is moved to bring the indicator 92 thereunder, a staple will be applied to copy sets indicative of the staple position illustrated by the line 106. The staple line 107 without a corresponding indication reference line tells the operator that the copy sets will have a second staple applied thereto, but this task will be subject of the B stapler device.

It will be noted that the stapling position for a 11 inch long copy set having only one staple applied thereto, as effected by the A stapler, as depicted by the pictograph 101, is at a different location than for the counterpart staple when the copy set will have two staples applied thereto, as depicted by the pictograph 104. These positions have been chosen in accordance with the human factors involved which indicate that when only one staple is to be used to fasten sheets, it is more desirable to have the staple closer to the upper left hand corner so that the user may turn the pages on a diagonal of the sheets. On the other hand, when two staples are to be applied to sheets being fastened, the staples are applied further from both the upper and lower left hand corners. In the illustrations of FIG. 6, a staple representative of the line 102 would be slightly closer to the adjacent corner than the staple representative of the line 106.

The pictograph 108 illustrates the situation when 14 inch paper is being utilized for copy sets and two staples are to be applied. As on the pictograph 104, only staple line 109 and only one reference line 110 are utilized for operator selection. The operator actuates the A buttons 98*a*, 98*b* to align the reference line 110 with the indicator 92 to accomplish stapling by the A stapler device at the designated position.

The pictograph 112 cooperates with the pictograph 106 to depict the second staple location for copy sheets having 8½ inch by 11 inch dimensions. The staple location line 113 is aligned with a reference line 114 for permitting the operator, while manipulating the B stapling device button 99*a*, 99*b* to align the indicator 93 with the reference 114 for the second staple. For the second staple to be applied to copy sets having a 14 inch length, the pictograph 115 cooperates with the pictograph 108 and depicts the second staple line 116 and cooperating reference line 117.

The pictographs 118 and 119 depict landscape staple positions for 11 inch length paper and 14 inch length paper, respectively. In landscape orientation of a copy set, the data on the sheet is arranged to be usable with the long dimension extending from left to right instead of from top to bottom as in portrait orientation. In landscape orientation, a single staple is applied and it will be positioned adjacent the upper left hand corner and closer thereto than the second or lower staple in a double stapled copy set. When the operator manipulates the B buttons 99*a*, 99*b*, to move the B stapler for this type of fastening of copy sheets, the manipulation will align the indicator 93 with either of the landscape reference lines 120 or 121 so as to denote desirable positioning of staples for this orientation.

It will be understood that the location of staples resulting from the foregoing description shown and taken in conjunction with FIG. 6 have been chosen only for illustration purposes. The location of the reference lines 103, 105, 110, 114, 117, 120 and 121, which are only suggested positions were chosen from a human factors point of view. In addition, an inch scale was utilized and standard United States sizes of paper discussed. It will be understood that the scale 100 could be scribed to the metric scale and that foreign sizes of paper could be utilized.

From the foregoing, it will be appreciated that the present invention provides an operator with an infinite variety of staple locations in a finishing station whereat sheets are fastened by staples. The staples may be preformed and be dispensed by two or more stapling devices, as illustrated in the foregoing description and drawings. In the alternative, two or more stitchers may be utilized which cut and form staples or other fastening elements from a spool of wire or other material, and to apply the elements to sheets to be fastened. The present invention provides very accurate positioning of the fastening devices, and without the need to make any mechanical adjustments to the finishing hardware. The positioning can be made very quickly and by very simple determinations and operations. In aiding the attempt to accomplish infinite positioning, the operator may apply a sheet to the scale 100 by positioning the length edge of the sheet thereto starting with the upper left hand corner of the sheet on the "0" indicator on the scale. While holding the sheet in this position, the operator may manipulate the buttons 98*a*, 98*b*, 99*a* and 99*b* to position the respective indicators 92, 93 to desired positions of staples by actually observing where the staples will be applied relative to the sheet.

While the invention has been described with reference to the structure disclosed, it is not confined to the details set forth, but is intended to cover such modifications or changes as may come within the scope of the following claims.

We claim:

1. In a fastening apparatus having two or more fastening devices adapted to apply one or more fastening elements relative to an edge of sheets of material to bind the same, the improvement comprising:

a drive means associated with each of the fastening devices for moving the respective device in either direction along a line parallel to the edge to be fastened, control means connected to each of said drive means for actuating the same selectively in either direction and for a desired distance along said line, and means for indicating the location of each of the fastening devices in relation to an edge of various sizes of sheets to be fastened.

2. The apparatus of claim 1 wherein said fastening devices are staplers.

3. In a stapling or stitching apparatus having two or more stapling or stitching devices adapted to apply one or more staples relative to an edge of sheets of material to bind the same, the improvement comprising:

a drive means associated with each of the stapling or stitching devices for moving the respective device in either direction along a line parallel to the edge to be stapled, control means connected to each of said drive means for actuating the same selectively in either direction and for a desired distance along said line, means for indicating the location of each of the stapling or stitching devices in relation to an edge of various sizes of sheets to be stapled, and operator selecting means operatively connected to each of said drive means for positioning each of the devices selectively in accordance with selected indication present by said means for indicating the location of each of the devices.

* * * * *